US005791764A

United States Patent [19]

Jaksich

[11] Patent Number: 5,791,764

[45] Date of Patent: Aug. 11, 1998

[54] FLUORESCENT LIGHT FIXTURE WITH EXTRUDED WIRE WAY COVER MOUNT

[75] Inventor: Milenko Jaksich, Mission Oaks, Calif.

[73] Assignee: Thin-Lite Corporation, Camarillo, Calif.

[21] Appl. No.: 766,290

[22] Filed: Dec. 13, 1996

[51] Int. Cl.[6] ..... F21S 3/00

[52] U.S. Cl. ..... 362/222; 362/223; 362/225; 362/362

[58] Field of Search ..... 362/221, 222, 362/223, 224, 217, 225, 362, 375; 174/50, 95, 97, 101

[56] References Cited

U.S. PATENT DOCUMENTS

| | | | |
|---|---|---|---|
| 3,117,729 | 1/1964 | Silvers et al. | 362/222 |
| 3,159,352 | 12/1964 | Wakefield et al. | 362/222 |
| 3,209,140 | 9/1965 | Nieder-Westermann et al. | 362/222 |
| 3,555,268 | 1/1971 | Zurawski | 362/220 |
| 3,647,148 | 3/1972 | Wince | 362/223 |
| 3,860,829 | 1/1975 | Fabbri | 362/148 |
| 4,166,195 | 8/1979 | Schwab | 174/95 |
| 4,338,653 | 7/1982 | Marrero | 362/223 |
| 4,342,072 | 7/1982 | Guritz | 362/222 |
| 4,390,930 | 6/1983 | Herst et al. | 362/224 |
| 4,415,957 | 11/1983 | Schwartz | 362/297 |
| 4,464,707 | 8/1984 | Forrest | 362/222 |
| 4,554,619 | 11/1985 | Bansbach et al. | 362/222 |
| 4,573,111 | 2/1986 | Herst et al. | 362/223 |
| 4,644,454 | 2/1987 | Herst et al. | 362/224 |
| 4,698,733 | 10/1987 | Griffin | 362/222 |
| 4,814,954 | 3/1989 | Spitz | 362/217 |
| 5,012,395 | 4/1991 | Wettengel et al. | 362/222 |
| 5,171,085 | 12/1992 | Jaksich | 362/147 |
| 5,186,537 | 2/1993 | Katoh et al. | 362/223 |
| 5,440,470 | 8/1995 | Ly | 362/341 |
| 5,479,327 | 12/1995 | Chen | 362/222 |

*Primary Examiner*—Alan Cariaso

*Attorney, Agent, or Firm*—Fulwider Patton Lee & Utecht, LLP

[57] ABSTRACT

A light fixture with extruded wire way cover mount for quick engagement and disengagement of the wire way cover and fixture housing. The fixture housing is extruded to form a recessed channel with a pair of elongated, opposing retainer lips extending over the opposite sides of the channel to define respective retainer slots therebetween. A flexible wire way cover is provided and includes a pair of flanges for receipt in the respective retainer slots. A diffuser is also provided and is likewise formed with mounting flanges for receipt in respective diffuser retainer slots formed in the lateral side walls of the housing in overlying relation with the wire way cover.

23 Claims, 2 Drawing Sheets

FLUORESCENT LIGHT FIXTURE WITH EXTRUDED WIRE WAY COVER MOUNT

BACKGROUND OF THE INVENTION

1. Field of the Invention

The present invention relates to light fixtures and, more particularly, to a fluorescent light fixture including a wire way cover to encase the electrical circuitry within the fixture.

2. Description of the Prior Art

Lighting fixtures are well known devices used for mounting electrical sockets and associated electrical circuitry in an attractive housing. Such fixtures are often used in offices and the like, but are also frequently used in recreational and other vehicles to provide a source of light inside such vehicles. Those fixtures are typically formed having electrical components housed therein which provide electrical power to the light tubes mounted within the fixture. Such electrical components are often concealed from the light tubes by means of a wire way cover, which detachably engages the fixture housing thereby shielding the electrical components from exposure to the heat generated by the light tubes during operation thereof. In fact, safety restrictions promulgated by Underwriters Laboratories and others require that wire way covers be included and that they be mounted on the fixtures during shipment thereof from the manufacturer.

The prior art assemblies for attaching the wire way covers to the fixtures all suffer from one or more serious shortcomings. It has been common practice to provide an outwardly projecting, threaded stud on the back wall of the fixture housing, and to form a complementary bore in the wire way cover. A mating screw is then threadedly engaged with the stud to maintain the wire way cover in position. These prior art devices, while performing their intended purposes of maintaining the wire way cover engaged with the fixture housing, are relatively expensive for use in inexpensive fixtures, as the manufacturing costs can be somewhat significant and the assembly procedure inconvenient and cumbersome as a rivet gun or the like is required to install the threaded stud. In addition, the procedure for mounting and dismounting the wire way cover is relatively time consuming as the screw must be disengaged from the stud before the wire way cover can be removed. This is significant since, due to safety restrictions, the wire way cover often must be mounted at the manufacturing site and then must typically be removed at the installation site for the purpose of mounting the light fixture. Then, once the fixture has been mounted from the ceiling or wall of, for instance, a recreational vehicle, the wire way cover must again be installed. In order to mount the wire way cover in these prior art devices, the wire way cover must be properly positioned in overlying relationship with the electrical components inside the housing, the bore of the wire way cover must be aligned with the threaded stud, and the wire way cover must be held in position while extending the mating screw through the wire way cover bore and into engagement with the internal threads formed in the stud.

Many attempts have been made to provide an inexpensive fluorescent tube light fixture which is inexpensive to manufacture and is convenient to mount and repair. One such effort led to the development of a formed sheet metal fixture having a housing with a back wall punched to form longitudinally extending mounting strips punched outwardly from the sheet forming the back wall to create respective longitudinal slots having the strips displaced forwardly from the plane thereof to define respective gaps between the respective strips and back wall for receipt therein of the opposed mounting flanges of a flexible wire way cover. A form of such device is disclosed in my U.S. Pat. No. 5,171,085, and assigned to the assignee of the rights in the instant invention. While having enjoyed commercial success, the device suffers the shortcoming that punching out of the retainer strip from the back wall tends to detract from the structural integrity of such back wall thus rendering it somewhat flimsy. Additionally, the relatively thin gauge sheet metal forming the housing provides insufficient metal body to allow for practical attachment of components thereto without the use of rivets and the like which often serve to leave a raised head on the back side of the housing which tends to stand the housing off from the mounting surface. Finally, the punching and installation of fasteners in such a housing is relatively labor intensive driving the cost of manufacture up to such a point that it is often impractical to employ such a fixture in many different applications.

In effort to overcome some of the shortcomings of such sheet metal construction, others have previously proposed to construct fluorescent lighting fixtures from channel shaped aluminum stock, and have constructed the fixture by punching a pattern of rivet bores in the back wall and driving a plurality of shoulder rivets into such bores. The rivets include respective enlarged heads spaced outwardly from the back wall to define slots therebetween. A flexible wire way cover is formed with out-turned flanges at its opposite lateral sides which are placed beneath the respective rivet heads to releasably hold the wire way cover in position. A device of this type is disclosed in U.S. Pat. No. 4,698,733, also assigned to the assignee of the rights in the present invention. While having gained great commercial acceptance, it has been discovered that the manufacture of such a housing requires jigbore and rivet operations in addition to the extruding operation of the housing. Thus such a device is relatively expensive to manufacture and therefore incorporation of such a device in light fixtures intended to be relatively inexpensive is unfeasible. In addition, the rivets also detract from the overall flat surface area of the back wall, thereby limiting to a degree the options available with respect to mounting of the light sockets in the housing. Moreover, the way cover itself sets flush on the front surface of the back wall thus creating a relatively high profile projecting out from the front surface of such back wall such a distance as to occupy a major portion of the overall depth of such fixture and limiting the extent to which the profile of the covering diffuser can be lowered on such fixture.

As such, it will be appreciated that there continues to be a need for a light fixture apparatus which permits quick engagement and disengagement of a wire way cover from the fixture housing while not interfering with the ability to mount light sockets from the housing, and which furthermore is relatively simple to manufacture and therefore is relatively inexpensive. The present invention addresses such needs as well as others.

SUMMARY OF THE INVENTION

Briefly, and in general terms, the present invention is directed to a light fixture apparatus which allows for efficient engagement and disengagement of a wire way cover thereon. The apparatus includes a housing formed with a generally planar back wall having an extruded, recessed channel formed generally centrally thereon. The channel extends the length of the housing and defines an upwardly facing base. A pair of confronting, laterally inwardly extending retainer lips are formed on the opposite lateral sides of the channel along the longitudinal length thereof. The retainer lips are spaced upwardly from the front face of the base and formed integral with the back wall to define a pair of longitudinal, laterally inwardly facing cover retainer slots on the opposite lateral ends of the channel. A flexible, elongated wire way cover is provided and includes a pair of longitudinally extending, laterally outwardly projecting mounting flanges sized for receipt in the respective slots to securely and releasably engage the wire way cover with the fixture housing. The housing is further formed with a pair of upwardly extending, longitudinal side walls which include respective diffuser retainer slots for receipt of the respective flanges of a diffuser to thereby mount the diffuser on the housing upwardly from the wire way cover.

Other features and advantages of the present invention will become apparent from the following detailed description, taken in conjunction with the accompanying drawings which illustrate, by way of example, the features of the invention.

DETAILED DESCRIPTION OF THE PREFERRED EMBODIMENT

Figure 1:
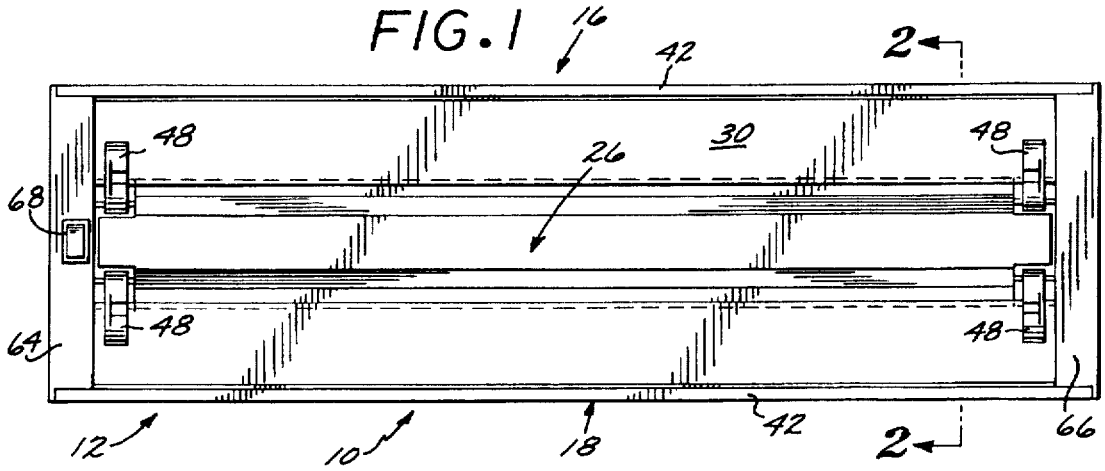
FIG. 1 is a top plan view of a light fixture apparatus embodying the present invention.

In the following detailed description, like reference numerals will be used to refer to like or corresponding elements in the different figures of the drawings. Referring now the drawings, and particularly to FIG. 1, there is shown, generally, a light fixture apparatus 10 embodying the present invention. The light fixture apparatus includes, generally, a fixture housing 12 including an elongated back wall 14 and a pair of oppositely disposed, upwardly projecting side walls 16 and 18 (FIG. 2). The back wall is extruded to form generally centrally thereon an elongated, recessed channel 20 and a pair of oppositely disposed, confronting, inwardly extending retainer lips 22 which define respective longitudinal slots 24 therebelow. A wire way cover, generally designated 26, is provided and is formed with respective out-turned, longitudinal flanges 28 and 29 sized for nesting in the respective slots. A generally channel shaped diffuser, generally designated 30, is configured for releasable engagement with the respective side walls of the housing in overlying relation with the wire way cover to close off the interior of the housing.

The prior art light fixture apparatus fail to provide a relatively inexpensive fluorescent light tube fixture which is inexpensive to manufacture and convenient to mount and repair. Such prior art apparatus typically require that rivets be installed or that the housing be punched in order to allow for mounting a wire way cover from the housing, thereby substantially increasing the costs of the finished device. In addition, punching the back wall of the housing tends to detract from the structural integrity of such back wall, while installing rivets in the back wall is not only time consuming and expensive, but also results in a reduction of the overall flat surface area of the back wall. Furthermore, in these prior art devices the wire way cover sits flush on the upwardly facing surface of the back wall, thus creating a relatively high profile apparatus. The fixture apparatus of the present invention allows for rapid engagement and disengagement of the wire way cover and diffuser from the housing, while not sacrificing these other desirable features.

Figure 2:
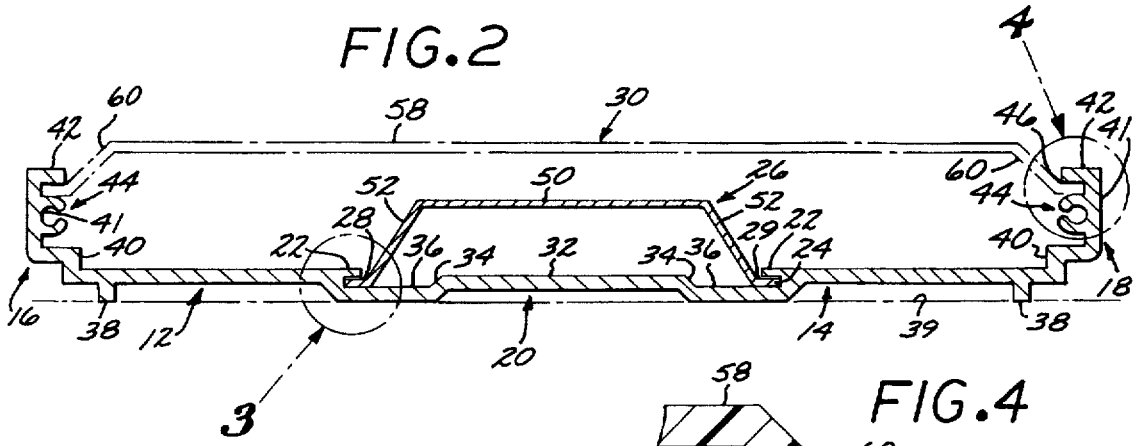
FIG. 2 is a transverse cross-sectional view, in enlarged scale, taken along the line 2—2 of FIG. 1.
Figure 3:
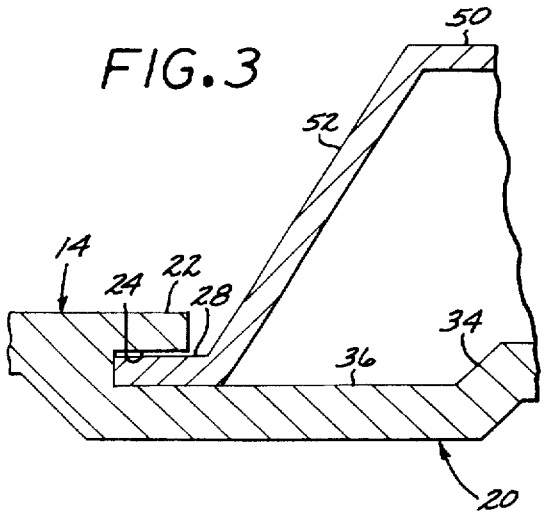
FIG. 3 is a fragmented sectional view, in enlarged scale, taken of the area 3 of FIG. 2.

The housing 12 is generally box shaped and terminates at its opposite lateral ends in the upwardly extending side walls 16 and 18 (FIG. 2). The housing further includes the back wall 14 which is generally planar and extruded to form the elongated, centrally formed recessed channel defining a base 20. The base includes a planar central platform 32 which terminates at its opposite lateral sides in respective downwardly and outwardly sloped transitions 34 which lead to respective laterally outwardly extending longitudinal ribs 36. The platform serves to mount thereon electrical circuitry (not shown) used to provide power to electrical sockets mounted in the housing. Overhanging the lateral outer ends of the respective ribs are the inwardly projecting, longitudinally extending retainer lips 22. The lips are formed integral with the housing during the extrusion process and are formed co-planar with the back wall. The ribs and retainer lips cooperate to define therebetween the elongated slots 24 (FIGS. 2 and 3). Projecting downwardly from the back face of the back wall adjacent the opposite lateral edges thereof are respective elongated feet 38 including distal ends which are co-planar with the back faces of the respective ribs. Thus the feet and ribs provide four points of contact forming a stable platform for mounting on a mounting surface 39 such as a wall or ceiling or the like. It will be appreciated that the back wall 14 may also be formed with one or more spaced apart mounting bores (not shown) to provide for mounting the housing to the mounting surface.

It will also be appreciated that by forming the channel so that it is recessed relative to the front face of the back wall 14, the retainer lips 22 may be formed in co-planar relationship with the front face of the back wall to thereby increase the overall flat surface area of the back wall, rather than requiring that the retainer lips be punched through the back wall which would necessarily reduce the flat surface area of the back wall. In addition, it will be appreciated that fabrication of the housing in the light fixture apparatus 10 of the present invention requires only a minimal number of machining steps. Once the housing 12 has been extruded to form the recessed channel and retainer lips 22, the housing requires no further machining to provide the wire way cover mount assembly. Thus, no additional steps are required for punching the rivet holes or installation thereof installing steps are required, which significantly reduces machining costs which eliminates the material costs for the rivets.

The side walls 16 and 18 include respective upwardly projecting extensions 40 extending upwardly from the opposite lateral sides of the back wall 14 (FIG. 2). The extensions then turn and extend laterally outwardly and connect at their distal extremities to upwardly extending extensions 41. Formed on the inwardly facing surfaces of the respective extensions 41 at the upper ends thereof are respective laterally inwardly projecting flanges 42. Formed on the respective extensions downwardly from the respective flanges are generally C-shaped elongated screw races, generally designated 44, which are internally threaded for receipt of respective mounting screws (not shown). Thus the respective flanges and screw races cooperate to define therebetween respective elongated diffuser retainer slots 46 for engaging the diffuser 30 to mount the diffuser from the housing as described in greater detail below.

The back wall 14 has mounted thereon two pair of spaced apart, confronting light tube sockets 48 mounted adjacent the respective opposite longitudinal ends thereof on opposite sides of the channel 20 (FIG. 1). The sockets are electrically connected to electrical circuitry (not shown) mounted on the platform 32 and which serves to provide electrical power thereto. The sockets are designed for releasable engagement with fluorescent light tubes (not shown) to mount such tubes in the housing and selectively conduct electrical power from the electrical circuitry to the respective tubes.

The wire way cover 26 is generally channel shaped in lateral cross-section and formed with an elongated, planar front plate 50 which connects at its opposite lateral extremities with downwardly and outwardly angling side walls 52 which connect at their respective lateral extremities with the out-turned mounting flanges 28 and 29 (FIG. 2). Such flanges are sized for making a close fit in the respective slots 24 (FIG. 3). The wire way cover is formed of a flexible material such as aluminum sheet to allow the distal ends of the respective side walls to be flexed inwardly so that, for instance, the flange 28 may clear the overhanging retainer lip 22 so that the wire way cover may be quickly and easily disengaged from the housing 12. When it becomes desirable to re-install the wire way cover, the worker may simply exert an inward force on one or both of the side walls 52 and lower the wire way cover over the channel 20 so that the flanges contact the respective upwardly facing surfaces of the ribs 36 and are clear of the respective retainer lips. The worker may then release the side walls of the wire way cover such that the bias of the cover forces the respective flanges laterally outwardly to nest in the respective slots 24 to thereby connect the wire way cover and housing.

The wire way cover 26 is utilized to seal off the electrical circuitry (not shown) from the rest of the housing. This serves to isolate the circuitry from the light tubes to thereby avoid prolonged exposure of such circuitry to excessive heat generated by the light tubes during operation thereof, as well as isolating the circuitry from a worker who may need to replace one or both of the light tubes. Thus the circuitry will not be subjected to potential damage during such replacements, nor will the worker be at risk of injury from accidental contact with the circuitry.

It will be appreciated that the wire way cover 26 may assume many different cross-sectional configurations so long as there is sufficient space between the cover and the channel 20 to house the electrical circuitry therein. For example, the cover may be formed having a relatively low profile for use in light fixtures intended to have an overall low profile, such as the light fixture 10 shown in FIG. 2. It will be appreciated that, due to the recessed nature of the channel and the retainer lips 22 being formed co-planar with the back wall 14, the profile of the wire way cover is lowered compared to fixture apparatus where the wire way cover sits on the front surface of the back wall. In the preferred embodiment, the retainer lips have a thickness of approximately 0.035 inches. Thus the wire way cover is lowered behind the front plane of the back wall on the order of 0.035 inches, which serves to provide more vacant space in the interior of the housing and results in a greater distance between the diffuser and wire way cover.

Figure 4:
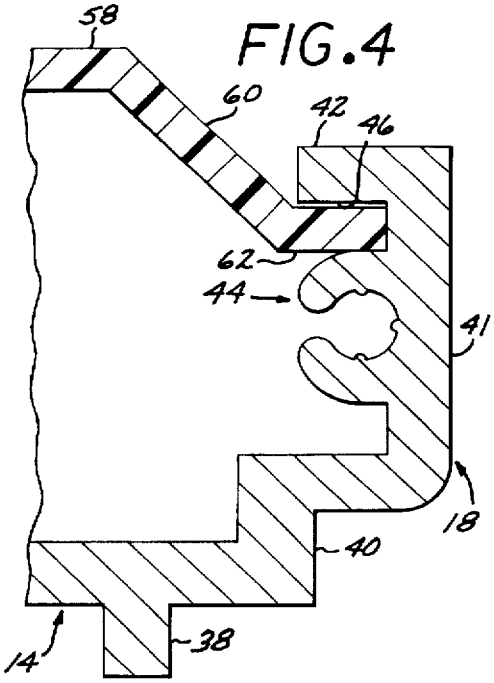
FIG. 4 is a fragmented sectional view, in enlarged scale, taken of the area 4 of FIG. 2.
Figure 5:
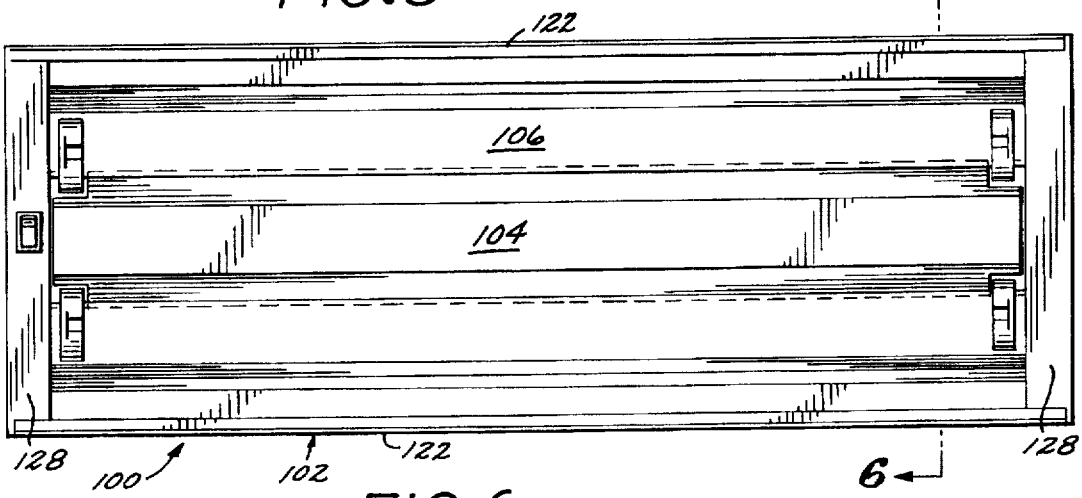
FIG. 5 is a top plan view of a second embodiment of the light fixture apparatus of the present invention.

The diffuser 30 is generally channel shaped and includes an elongated, substantially planar face plate 58 which connects at the respective opposite lateral ends thereof to downwardly and outwardly angled side walls 60 which turn and project laterally outwardly to define respective out-turned flanges 62 (FIG. 2). The respective flanges are sized for making a close fit in the respective diffuser retainer slots 46 formed in the respective side walls 16 and 18 (FIG. 4). The face plate and angled side walls are likewise formed of a flexible material such as molded plastic to allow a worker to flex the angled side walls inwardly and out of registration with the retainer slots to disengage the diffuser from the housing 12, thereby allowing the worker access to the wire way cover 26 and light tubes mounted on the back wall 14 of the housing. The diffuser 30 may be of a molded plastic such as polyacrylic resin or the like, and is translucent. In the preferred embodiment, the upper side of the diffuser (referring to FIG. 2) is ribbed (not shown) to improve the diffusion characteristics thereof.

The light fixture apparatus 10 includes at the respective opposite longitudinal ends thereof respective end caps 64 and 66 engaged with the respective ends of the housing 12 (FIG. 1). The end caps are formed having a cross-sectional configuration matching the profile of the housing and diffuser 30 when engaged together. The end caps are formed with a pair of spaced apart counter bores (not shown) in predetermined positions for registration with the respective internally threaded screw races 44 formed in the respective side walls 16 and 18. Mounting screws (not shown) are then extended through the respective bores and threadedly engaged with the screw races to engage the end caps with the housing. The end caps are preferably formed of a molded plastic or the like.

The end cap 64 is formed with a toggle switch 68 thereon (FIG. 1). The toggle switch is electrically connected to the electrical circuitry (not shown) to be housed beneath the wire way cover 26 and mounted on the platform 32. Thus the toggle switch may be used to alternately actuate and deactivate the light tubes.

Thus it will be appreciated that the manufacture of the fixture apparatus 10 is relatively straight-forward and does not require a large number of steps. The manufacture of the housing 12 involves a one step process whereby the housing is extruded to form the recessed channel 20 and back wall 14 with the integral retainer lips 22. The respective light tube sockets 48 may then be mounted on the back wall on opposite sides of the channel. The electrical components (not shown) may then be mounted on the platform 32 and electrically connected to the respective sockets. The end caps 64 and 66 are then installed by inserting mounting screws (not shown) therethrough and into the respective screw races 44. If desirable, mounting bores (not shown) may be formed in the back wall in spaced relation. The housing may then be positioned on a flat surface with the longitudinal feet 38 and ribs 36 abutting such mounting surface thereby forming a stable platform for mounting the housing.

In use, a worker may take an assembled fixture apparatus 10 including a housing 12, wire way cover 26 and diffuser 30 and mount the fixture apparatus on a wall or ceiling of a recreational vehicle, office or the like. The diffuser and wire way cover may be efficiently and easily disengaged from the housing to allow the worker access to the interior of the housing for purposes of mounting the fixture apparatus, for installing light tubes, connecting the electrical circuitry to an external power source, or the like. Once such procedures have been performed, the worker may take the wire way cover and squeeze the side walls 52 with his or her hands and place the flanges 28 and 29 in contact with the respective ribs 36. The worker may then release the wire way cover such that the bias in the side walls drives the flanges 28 and 29 into the respective longitudinal slots 24 to connect the wire way cover and housing. The worker may then take the diffuser and likewise squeeze the side walls 60 thereof together and place the diffuser in position with the mounting flanges 62 in a position coplanar with the diffuser retainer slots 46. The worker may then release the diffuser such that the diffuser assumes its normal configuration with the flanges driven laterally outwardly and into the respective retainer slots to connect the diffuser and housing together.

It will be appreciated that it is subsequently necessary to access the interior of the light fixture apparatus 10, the worker may simply grab the diffuser by hand and again squeeze the angled side walls 60 together to drive the mounting flanges 62 out of registration with the slots 46 to disengage the diffuser from the housing 12. Should the worker then want access to the circuitry housed beneath the wire way cover 26, he or she may similarly grab the wire way cover and squeeze the angled side walls 52 together to remove the cover from the housing. It will thus be appreciated that assembly and disassembly of the fixture apparatus 10 of the present invention is very efficient.

Referring to FIGS. 5 through 8, there is shown a second embodiment of the present invention. A light fixture assembly, generally designated 100, is shown for mounting from a wall or ceiling or the like. The fixture assembly includes, generally, a housing 102, a wire way cover 104 and a diffuser 106.

Figure 6:
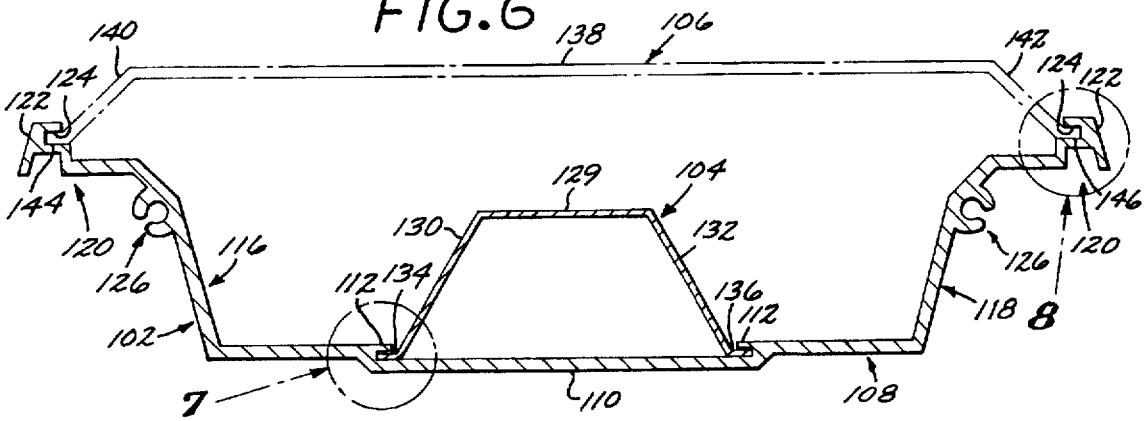
FIG. 6 is a transverse cross-sectional view, in enlarged scale, taken along the line 6—6 of FIG. 5.
Figure 7:
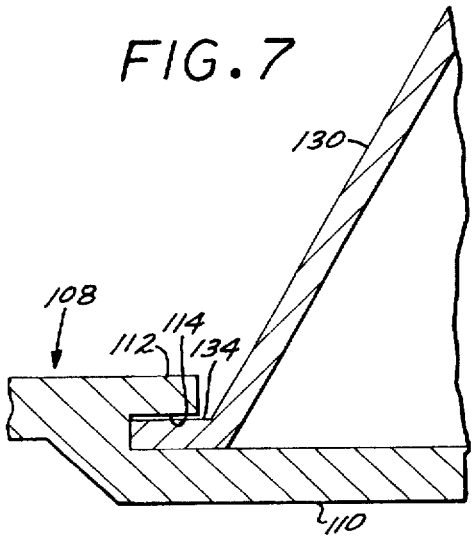
FIG. 7 is a fragmented sectional view, in enlarged scale, taken of the area 7 of FIG. 6.
Figure 8:
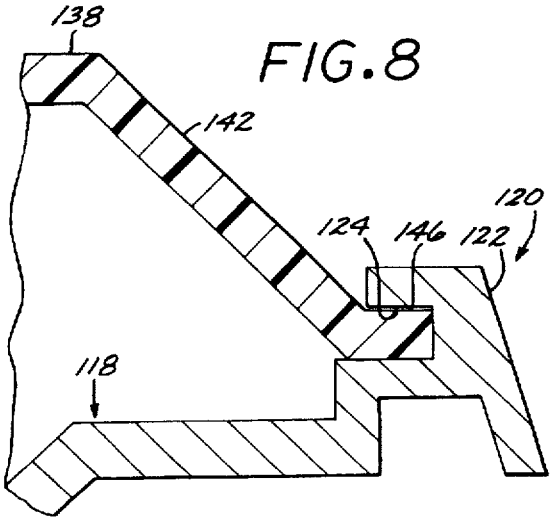
FIG. 8 is a fragmented sectional view, in enlarged scale, taken of the area 8 of FIG. 6.

The housing 102 includes an elongated, substantially planar base plate, generally designated 108, with a centrally formed, recessed channel 110 (FIG. 6). The base plate is formed with a pair of confronting retainer lips 112 which cantileverly extend a predetermined distance over the opposite lateral sides of the channel to define respective slots 114 between the retainer lips and front face of the channel (FIG. 7). The housing further includes respective side walls, generally designated 116 and 118, which angle upwardly and outwardly from the opposite lateral sides of the base plate. The respective side walls then turn and project laterally outwardly and connect at their lateral outer ends with respective diffuser mount assemblies, generally designated 120 (FIGS. 6 and 8). The respective diffuser mount assemblies include elongated, generally C-shaped mounting members 122 which define respective inwardly facing diffuser retainer slots 124 for engaging the diffuser as described in more detail below. Formed on the outwardly facing surfaces of the angled side walls are respective elongated, threaded C-shaped screw races, generally designated 126, for mounting respective end caps 128 to the opposite longitudinal ends of the housing 102.

The back face of the channel 110 is substantially planar and extends rearwardly from the housing 102 a predetermined distance. The back face is relatively wide to provide a suitable mounting platform for the fixture apparatus 100 and may have mounting bores (not shown) formed therein in spaced relation.

The wire way cover 104 is generally trapezoidal shaped with an open base and includes a planar upper face 129 which connects at its opposite lateral ends with respective downwardly and outwardly angling side walls 130 and 132 which terminate at their extremities in elongated, out-turned mounting flanges 134 and 136. The wire way cover is formed of a flexible material such as aluminum sheet metal so that it may be flexed so that the respective flanges are driven inwardly and out of registration with the retainer lips for selectively mounting and dismounting the wire way cover from the housing.

The diffuser 106 is generally channel shaped and includes a planar front face 138 which connects at its opposite lateral ends with downwardly and outwardly angling side walls 140 and 142, such walls terminating at their outer extremities in out-turned flanges 144 and 146 sized for nesting in the inwardly facing slots 124. The diffuser is likewise formed of a flexible material such as molded plastic so that the side walls and front face may be flexed to withdraw the flanges from the respective slots to remove the diffuser from the housing as desired.

From the foregoing, it will be appreciated that the light fixture apparatus of the present invention provides for quick engagement and disengagement of the wire way cover and diffuser from the fixture housing while not detracting from the amount of available surface area needed for mounting light sockets or the like on the housing. Furthermore, the light fixture apparatus of the present invention is relatively simple to manufacture and therefore is relatively inexpensive.

While particular forms of the invention have been illustrated and described, it will be apparent that various modifications can be made without departing from the spirit and scope of the invention. Accordingly, it is not intended that the invention be limited, except as by the appended claims.

What is claimed is:

1. A light fixture comprising:

an elongated, extruded channel shaped housing formed with a back wall and laterally disposed housing side walls formed with laterally inwardly opening confronting diffuser retainer slots, said back wall being further formed with a front surface disposed in a first plane and a central, longitudinally extending recess disposed behind said first plane to define a recessed wall and laterally inwardly projecting retainer lips, spaced a predetermined lateral distance apart and spaced forwardly of said recessed wall and configured to define therebehind respective cover retainer slots; and a flexible and resilient, channel shaped wire way cover configured with a front wall and laterally disposed cover side walls projecting rearwardly from said front wall to be turned outwardly at the respective distal extremities thereof to form respective mounting flanges, paced laterally apart a distance greater than said lateral distance, when said cover is in the relaxed position, said cover being sufficiently flexible to enable said cover side walls to he grasped and flexed to enable said flanges to be drawn together sufficiently to be removably received in the respective said cover retainer slots so tat upon release of said cover side walls said flanges will be urged into said retainer slots to be retained behind the respective said retainer lips.

2. The light fixture apparatus of claim 1 wherein:

said housing side walls are formed with respective tubular shaped screw races spaced behind the respective said diffuser retainer slots.

3. The light fixture apparatus of claim 1 wherein:

said housing is formed on its back side with a pair of laterally spaced apart stub flanges defining respective stand off feet.

4. The light fixture apparatus of claim 1 wherein:

said recessed wall is formed with a longitudinally projecting raised reinforcing rib.

5. The light fixture apparatus of claim 1 further including:

a flexible, elongated diffuser including a pair of oppositely disposed mounting flanges configured for releasable engagement with the respective said diffuser retainer slots.

6. The apparatus of claim 1 further including:

a plurality of light sockets mounted in confronting relationship on said back wall adjacent the opposite longitudinal ends of said housing.

7. The apparatus of claim 1 further including:

a pair of end caps connected to said housing at the opposite longitudinal ends thereof.

8. The apparatus of claim 1 wherein:

said housing is formed of aluminum.

9. The apparatus of claim 1 wherein:

the respective said retainer lips are formed integral with said back wall and are co-planar with said back wall.

10. The apparatus of claim 5 wherein:

said diffuser is formed of translucent, molded plastic.

11. A light fixture apparatus comprising:

an elongated housing including a back wall formed with a recessed, longitudinally extending channel defining a base and a pair of confronting, inwardly extending retainer lips spaced apart a predetermined distance at the opposite lateral sides of said channel and spaced from said base to define respective elongated slots therebetween;

a flexible and resilient, elongated channel shaped wire way cover including a pair of laterally disposed side walls configured with distal extremities formed with respective longitudinally extending, laterally outwardly projecting flanges configured to be, in the relaxed position, spaced apart a distance greater than said predetermined distance and sufficiently flexible to enable said side walls to be grasped and drawn together sufficiently to allow said flanges to be recessed for releasable receipt in the respective said slots; and a flexible, elongated diffuser configured for releasable engagement with said housing outwardly of said wire way cover.

12. The apparatus of claim 11 wherein:

the respective said retainer lips are formed integral with said back wall and are coplanar with said back wall.

13. The apparatus of claim 11 further including:

a plurality of light sockets mounted in confronting relationship on said back wall adjacent the opposite longitudinal ends of said housing.

14. The apparatus of claim 11 wherein:

said housing includes at the respective opposite lateral sides thereof upwardly extending side walls including respective longitudinally extending in-turned flanges defining respective diffuser retainer slots; and said diffuser includes a pair of mounting flanges for receipt in the respective said diffuser retainer slots to connect said diffuser and said housing.

15. The apparatus of claim 11 further including:

a pair of end caps connected to said housing at the opposite longitudinal ends thereof.

16. The apparatus of claim 11 wherein:

said housing is formed of aluminum.

17. The apparatus of claim 11 wherein:

said diffuser is formed of translucent, molded plastic.

18. A method of constructing a light fixture apparatus, said method comprising the following steps:

selecting a piece of metal stock, a plurality of light tube sockets, an elongated wire way cover including a front wall and laterally disposed flexible and resilient cover side walls projecting rearwardly from said front wall and turning outwardly at the respective distal ends thereof to form respective mounting flanges normally spaced apart a selected distance, and a diffuser including an elongated front face and angled side walls terminating at the respective distal ends thereof in respective out-turned flanges;

extruding said metal stock to form a fixture housing including an elongated back wall formed with a central recess defining a base and a pair of confronting, laterally inwardly extending retainer lips spaced laterally apart a distance less than said selected distance and spaced upwardly from said base to define respective cover retainer slots between said lips and said base, and a pair of side walls extending upwardly from the respective lateral sides of said back wall and formed with laterally inwardly opening diffuser retainer slots;

mounting said light sockets on said back wall;

grasping said cover side walls and drawing them inwardly toward one another for receipt between said retainer lips and inserting said mounting flanges in the respective said cover retainer slots to upon release engage said wire way cover with said housing; and inserting said out-turned flanges of said diffuser in the respective said diffuser retainer slots to engage said diffuser with said housing.

19. A light fixture apparatus according to claim 11 wherein:

said housing is configured with a rectangular lateral cross section formed with lateral side walls and said retainer lips medially in said back wall.

20. A light fixture apparatus according to claim 11 wherein:

said way cover, in lateral cross section, is trapezoidal with an open base.

21. A light fixture apparatus according to claim 1 wherein:

said back wall is formed with at least one rearwardly projecting longitudinal rib and a pair of spacer feet disposed in flanking relationship therewith.

22. A light fixture apparatus according to claim 6 further including:

a plurality of fasteners for permanently affixing said light sockets on said back wall.

23. A light fixture apparatus according to claim 13 wherein:

a plurality of fasteners for permanently affixing said light sockets on said back wall.

* * * * *